US005531378A

United States Patent [19]

Roberts

[11] Patent Number: 5,531,378

[45] Date of Patent: Jul. 2, 1996

[54] STEAM-HEATED RADIATOR SYSTEM

[76] Inventor: Hayden S. Roberts, 2172 Dean St., Brooklyn, N.Y. 11233

[21] Appl. No.: 369,089

[22] Filed: Jan. 5, 1995

[51] Int. Cl.[6] ..... F24D 1/02

[52] U.S. Cl. ..... 237/67; 126/33

[58] Field of Search ..... 237/9 R, 67, 68, 237/71–74; 126/33; 99/417

[56] References Cited

U.S. PATENT DOCUMENTS

| | | | |
|---|---|---|---|
| 939,858 | 11/1909 | Pullen | 126/33 |
| 1,237,253 | 8/1917 | Paul | 237/9 |
| 2,006,193 | 6/1935 | Bell | 126/33 |
| 2,193,142 | 3/1940 | Price | 237/8 |
| 3,181,794 | 5/1965 | Baustian | 237/67 |
| 5,381,729 | 1/1995 | Hennessy et al. | 99/483 |

*Primary Examiner*—William E. Tapolcai

[57] ABSTRACT

A steam-heated radiator system comprising a radiator including an open reservoir for holding water therein adapted to be positioned within a restaurant steam table and a generally tubular heating coil positioned within the reservoir; a steam storage tank coupled to the heating coil for delivering steam thereto and couplable to a pressure boiler for receiving steam therefrom for subsequent use in the heating coil; a steam trap mechanism coupled to the heating coil for trapping water condensing from the steam; and a pump mechanism coupled to the steam trap mechanism for receiving the water condensed from the steam and couplable to a pressure boiler for transferring the water thereto for reheating.

4 Claims, 4 Drawing Sheets

STEAM-HEATED RADIATOR SYSTEM

BACKGROUND OF THE INVENTION

1. Field of the Invention

The present invention relates to a steam-heated radiator system and more particularly pertains to utilizing waste steam from a pressure boiler for heating water in a restaurant steam table with a steam-heated radiator system.

2. Description of the Prior Art

The use of steam heating systems is known in the prior art. More specifically, steam heating systems heretofore devised and utilized for the purpose of heating are known to consist basically of familiar, expected and obvious structural configurations, notwithstanding the myriad of designs encompassed by the crowded prior art which have been developed for the fulfillment of countless objectives and requirements.

By way of example, U.S. Pat. No. 3,822,855 to Hummelshoj discloses a casting mold with steam-heated water jacket. U.S. Pat. No. 4,274,390 to Azuma discloses an automotive hot water heater. U.S. Pat. No. 4,398,663 to Hegberg discloses a heating system with steam radiators. U.S. Pat. No. 4,412,648 to Ford et al. discloses a control valve assembly for steam radiators. U.S. Pat. No. 4,732,712 to Burnham et al. discloses a steam injection water heater.

While these devices fulfill their respective, particular objective and requirements, the aforementioned patents do not describe a steam-heated radiator system that utilizes waste steam from a boiler system to provide steam to a restaurant stem boiler for keeping consumables at a desired serving temperature.

In this respect, the steam-heated radiator system according to the present invention substantially departs from the conventional concepts and designs of the prior art, and in doing so provides an apparatus primarily developed for the purpose of utilizing waste steam from a pressure boiler for heating water in a restaurant steam table.

Therefore, it can be appreciated that there exists a continuing need for new and improved steam-heated radiator system which can be used for utilizing waste steam from a pressure boiler for heating water in a restaurant steam table. In this regard, the present invention substantially fulfills this need.

SUMMARY OF THE INVENTION

In the view of the foregoing disadvantages inherent in the known types of steam heating systems now present in the prior art, the present invention provides an improved steam-heated radiator system. As such, the general purpose of the present invention, which will be described subsequently in greater detail, is to provide a new and improved steam-heated radiator system and method which has all the advantages of the prior art and none of the disadvantages.

To attain this, the present invention essentially comprises, in combination, radiator. The radiator includes a rigid box-shaped reservoir for holding water therein. The reservoir is adapted to be positioned within a restaurant steam table. The reservoir has a bottom wall, a pair of opposed long walls, and a pair of opposed short walls with the walls connected to the periphery of the bottom wall and extended upwards therefrom to define a hollow interior and a top opening for allowing access to the interior, and a plurality of feet coupled to and extended downwards from the bottom wall for supporting the reservoir in a generally level orientation. The radiator includes a rigid elongated tubular heating coil disposed in the reservoir for heating water placed in the reservoir to form steam. The heating coil is formed of a thermally conductive material. The heating coil has an inlet valve at one end extended through a short wall of the reservoir, an output valve at the other end extended through the other short wall of the reservoir, and a serpentine intermediate portion therebetween disposed within the interior of the reservoir. Lastly, the radiator includes a plurality of clamps coupled between the heating coil and reservoir for holding the heating coil in a stationary horizontal position.

A steam storage tank is provided for storing steam from a pressure boiler for use at a later time. The steam storage tank includes a rigid housing having a concave bottom wall with a plurality of feet extended downwards therefrom, a tubular side wall coupled to and extended upwards from the bottom wall to define a hollow interior and a top opening for allowing access to the interior, and a concave top wall removably secured to the side wall and over the opening of the housing. The steam storage tank includes a steam chamber disposed within the interior. The steam chamber includes a bottom portion with an inlet valve extended through the side wall of the housing and with the inlet valve adapted to be coupled to and placed in communication with a pressure boiler, a top portion including an outlet valve extended through the side wall at a location above the inlet valve, and an hollow fluted intermediate portion therebetween. The steam storage tank includes a closable drain tap coupled to the bottom portion of the steam chamber and extended through the side wall for draining condensed water accumulated within the steam chamber. The steam storage tank includes a pressure relief valve coupled to the top portion of the steam chamber and extended through the top wall of the housing for tapping excess steam pressure from the steam chamber. The steam storage tank includes liquid oil disposed within the interior of the housing for insulating the steam chamber. The steam storage tank includes a removable oil drain plug coupled to the bottom wall for allowing the oil to be drained from the interior. Lastly, the steam storage tank includes an air vent coupled to the top wall of the housing for releasing air from the interior when the housing is being filled with oil.

A shut-off valve is included and has an input end coupled to and in communication with the outlet valve of the steam storage tank and an output end coupled to and in communication with the inlet valve of the heating coil. The shut-off valve has an opened orientation for allowing delivery of steam within the steam storage tank to the heating coil for dissipating heat and a closed orientation for preventing such delivery. A steam trap and thermostatic valve is included and has an input end and an output end with the input end coupled to the outlet valve of the coil for trapping water condensing from steam and regulating the temperature at which the condensed water is allowed to exit through the output end. Lastly, a circulating boost pump is included and has an input end coupled to and in communication with the output end of the steam trap and thermostatic valve and an output end adapted to be coupled to and placed in communication with a pressure boiler for transferring condensed water thereto for reheating.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved steam-heated radiator system which has all the advantages of the prior art steam heating systems and none of the disadvantages.

It is another object of the present invention to provide a new and improved steam-heated radiator system which may be easily and efficiently manufactured and marketed.

It is a further object of the present invention to provide a new and improved steam-heated radiator system which is of durable and reliable construction.

An even further object of the present invention is to provide a new and improved steam-heated radiator system which is susceptible of a low cost of manufacture with regard to both materials and labor, and which accordingly is then susceptible of low prices of sale to the consuming public, thereby making such a steam-heated radiator system economically available to the buying public.

Still yet another object of the present invention is to provide a new and improved steam-heated radiator system which provides in the apparatuses and methods of the prior art some of the advantages thereof, while simultaneously overcoming some of the disadvantages normally associated therewith.

Even still another object of the present invention is to provide a new and improved steam-heated radiator system for utilizing waste steam from a pressure boiler for heating water in a restaurant steam table.

Lastly, it is an object of the present invention to provide a new and improved steam-heated radiator system comprising a radiator including an open reservoir for holding water therein adapted to be positioned within a restaurant steam table and a generally tubular heating coil positioned within the reservoir; a steam storage tank coupled to the heating coil for delivering steam thereto and couplable to a pressure boiler for receiving steam therefrom for subsequent use in the heating coil; steam trap means coupled to the heating coil for trapping water condensing from the steam; and pump means coupled to the steam trap means for receiving the water condensed from the steam and couplable to a pressure boiler for transferring the water thereto for reheating.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
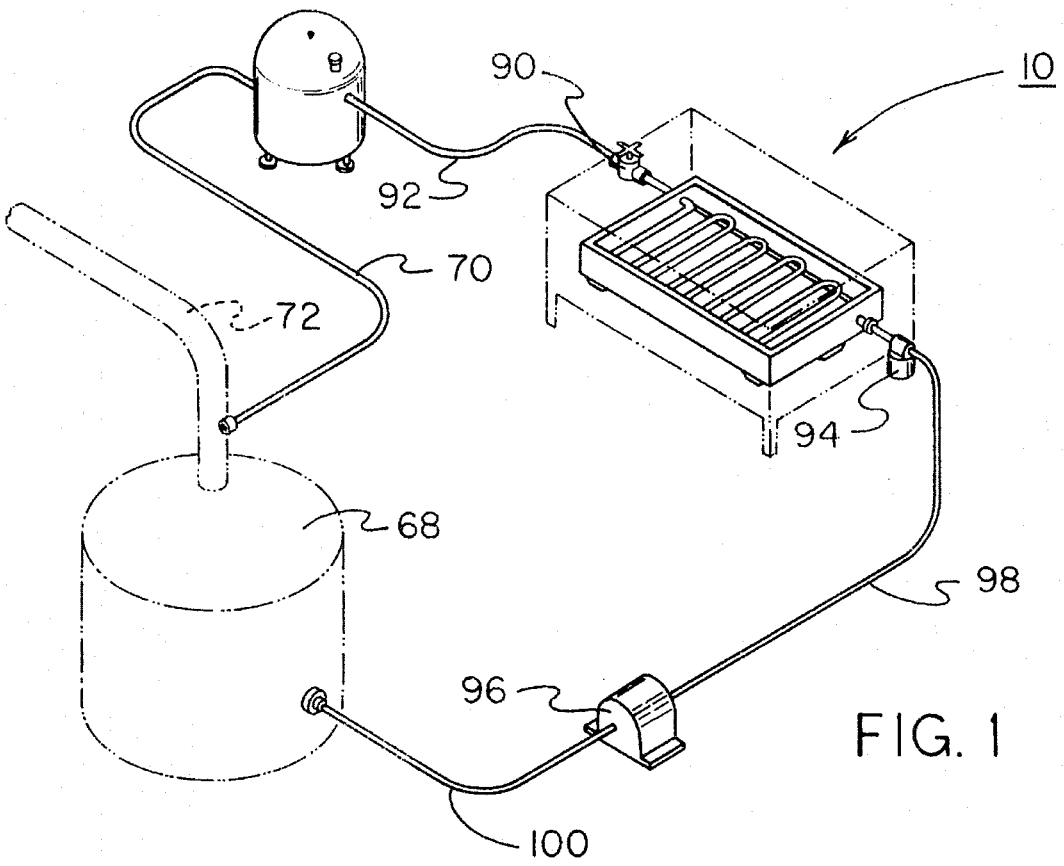
FIG. 1 is a perspective view of the preferred embodiment of the steam-heated radiator system constructed in accordance with the principles of the present invention.
Figure 2:
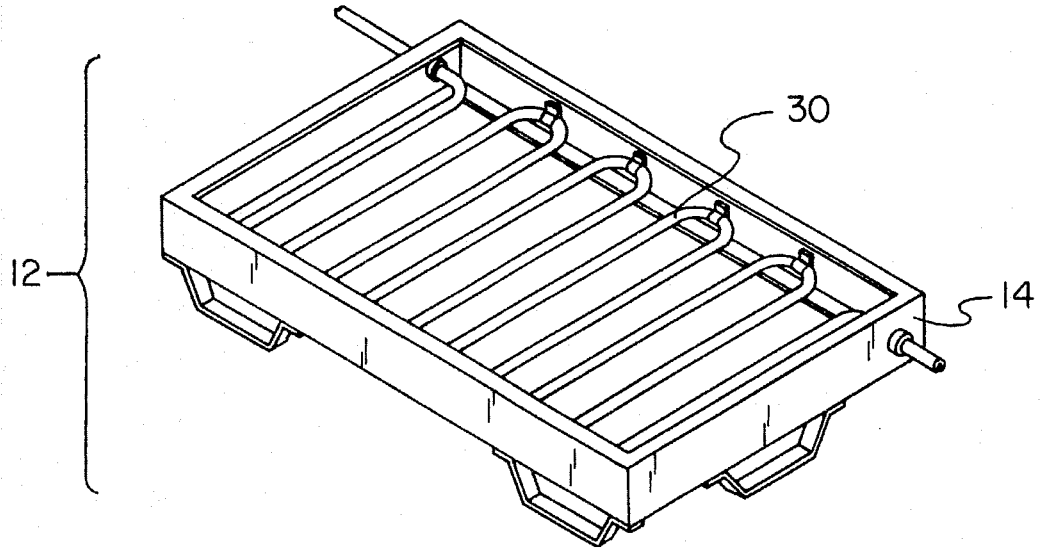
FIG. 2 is a perspective view of the reservoir and heating coil.
Figure 3:
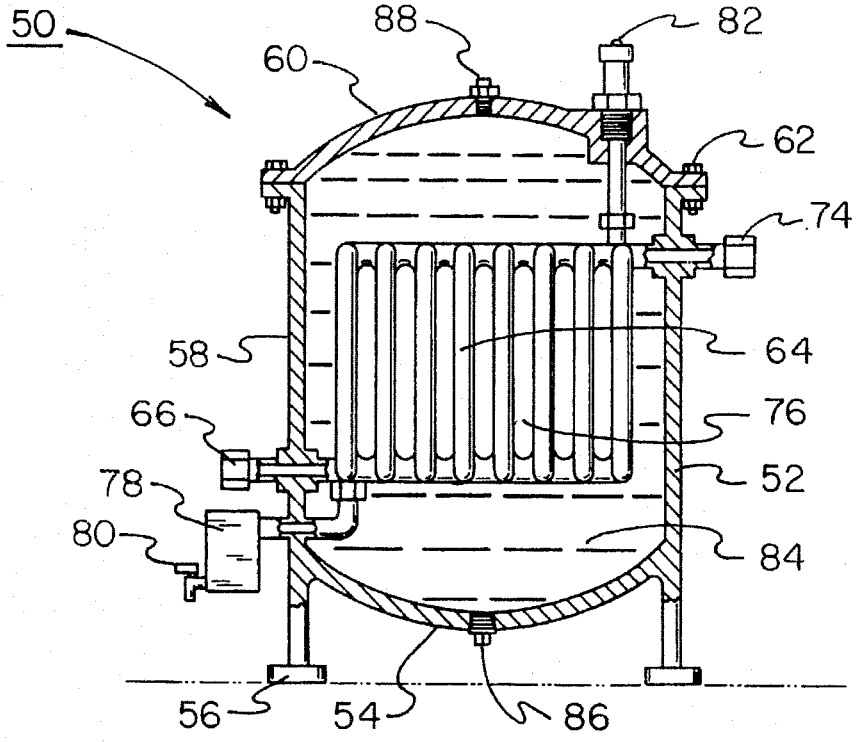
FIG. 3 is a cross-sectional view of the steam pressure storage tank of the present invention.
Figure 4:
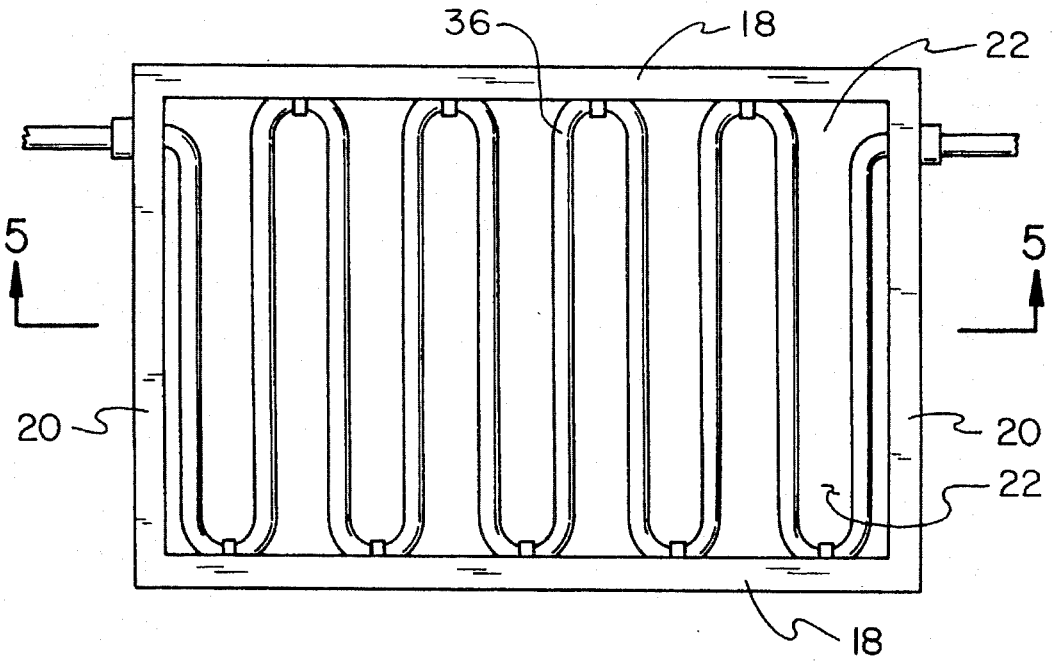
FIG. 4 is a plan view of the heating coil and its positioning within the reservoir.
Figure 5:
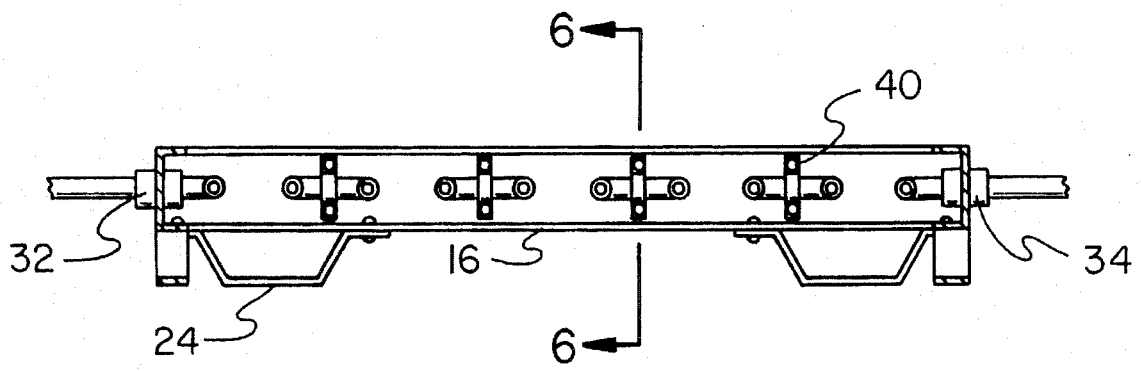
FIG. 5 is a cross-sectional view of the reservoir taken along the line 5—5 of FIG. 4.
Figure 6:
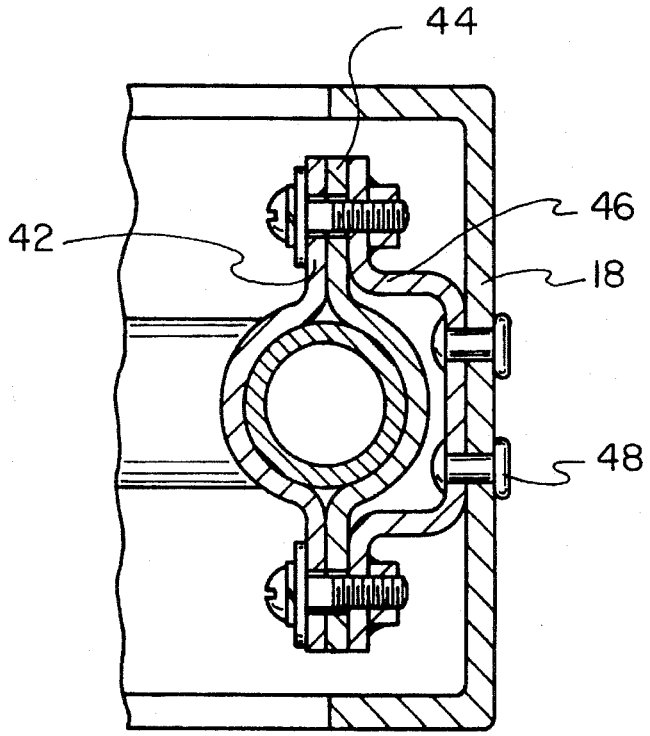
FIG. 6 is a cross-sectional view of one of the clamps used for securing the heating coil to the reservoir.

With reference now to the drawings, and in particular, to FIG. 1 thereof, the preferred embodiment of the new and improved steam-heated radiator system embodying the principles and concepts of the present invention and generally designated by the reference number 10 will be described.

Specifically, the present invention essentially includes five major components. The major components are the radiator, steam storage tank, shut-off valve, steam trap and thermostatic valve, and circulating boost pump. These components are interrelated to provide the intended function of utilizing waste steam from a pressure boiler for heating water in a restaurant steam table.

More specifically, it will be noted in the various Figures that the first major component is the radiator 12. The radiator includes three subcomponents. The subcomponents are the reservoir, heating coil, and clamps. These subcomponents are interrelated for allowing the radiator to perform its intended function.

The first subcomponent of the radiator is the reservoir 14. The reservoir is box-shaped in structure. It is formed of metal, plastic, or other similar rigid material. The reservoir is used for holding water therein for use in generating steam. The reservoir is adapted to be positioned within a restaurant steam table and provide steam for heating consumables to a selected temperature. The reservoir has a bottom wall 16, a pair of opposed long walls 18, and a pair of opposed short walls 20. The short walls and longs walls are joined at their edges, connected to the periphery of the bottom wall, and extended upwards from the bottom wall to define a hollow interior 22 and a top opening for allowing access to the interior. The reservoir also includes a plurality of feet 24 coupled to and extended downwards from the bottom wall. The feet are used for supporting the reservoir on a recipient surface in a generally level orientation.

The second subcomponent of the radiator is the heating coil 30. The heating coil is elongated and tubular in structure. It is formed of a rigid thermally conductive material such as metal. The heating coil is disposed in the reservoir for heating water placed within the reservoir to form steam for use by the steam table. The heating coil has an inlet fitting 32 at one end extended through a short wall 20 of the reservoir, an output fitting 34 at the other end extended through the other short wall of the reservoir, and a serpentine intermediate portion therebetween 36 disposed within the interior 22 of the reservoir. This intermediate portion is intended to be positioned beneath the surface of the water in the reservoir.

The third subcomponent of the radiator is the clamps 40. The present invention includes a plurality of clamps. The clamps are coupled between the heating coil and reservoir. The clamps are used for holding the heating coil in a stationary horizontal position. Each clamp includes a first brace 42, a second aligned and opposed brace 44 and a mounting base 46. The mounting base is coupled to the long wall 18 of the reservoir with rivets 48. The first brace and second brace are positioned around the coil and then coupled to the mounting base with a pair of bolts and complimentary washers.

Figure 7:
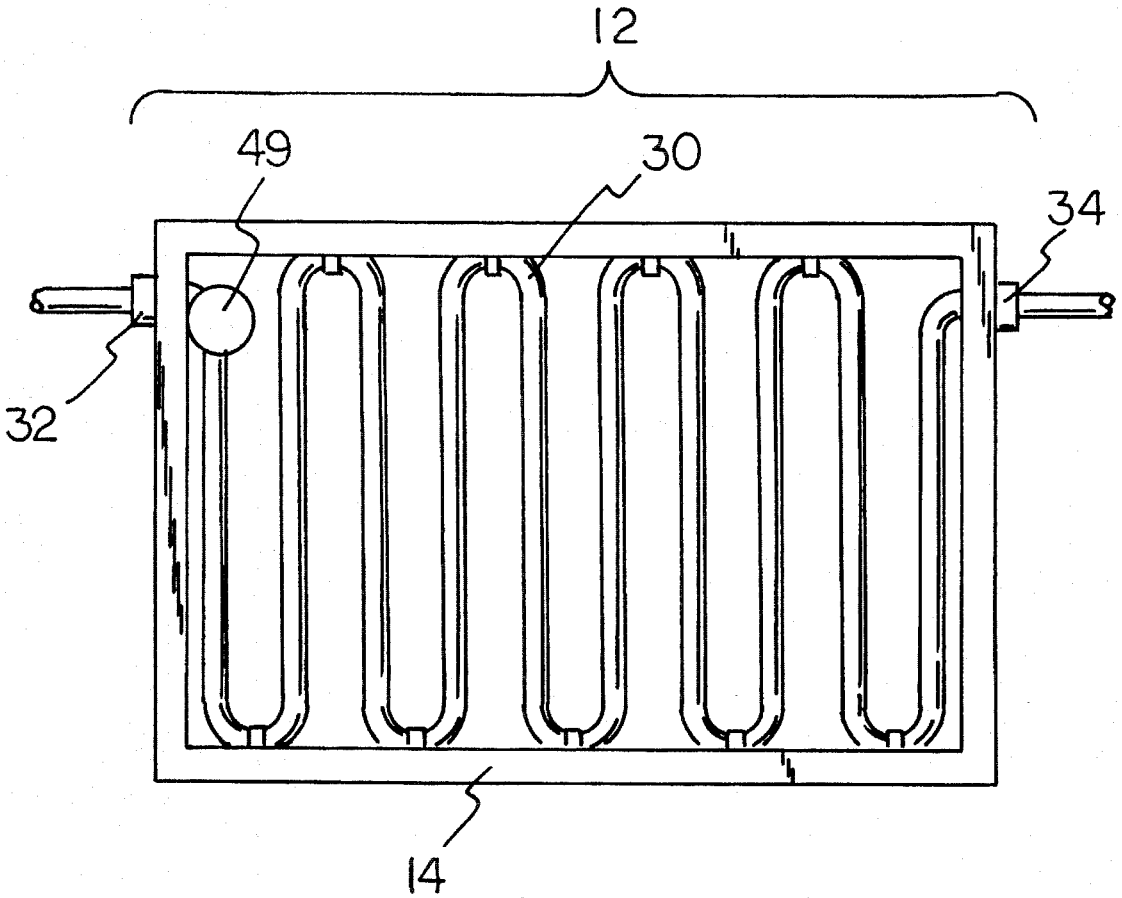
FIG. 7 is a plan view of an alternate embodiment of the radiator.

A second embodiment of the radiator 12 is shown in FIG. 7 and includes substantially all of the subcomponents of the preferred embodiment further including a thermostatic valve 49. The thermostatic valve is positioned in the reservoir 14 and coupled between the intermediate portion of the coil 30 and inlet valve 32 thereof. The thermostatic valve consists of a heat-sensing bulb that protrudes downwards within the water contained in the reservoir. The thermostatic value is settable at a selected temperature by a user for heating the water within the reservoir for generating steam. The thermostatic valve has an opened orientation for automatically allowing input steam to enter and heat the coil, thereby heating the water in the reservoir to the selected temperature. The valve has a closed orientation for preventing input steam from entering the coil when the water in the reservoir reaches the selected temperature. The automatic opening and closing of the thermostatic valve thus allows the temperature of water in the reservoir to be maintained for generating steam for heating.

The second major component is the steam storage tank 50. The steam storage tank is used for storing steam from a pressure boiler for use at a later time. This boiler could be located in a hotel, restaurant, or home. The steam storage tank includes seven subcomponents. The subcomponents are the housing, steam chamber, drain tap, pressure release valve, liquid oil, oil drain plug, and air vent. These subcomponents are interrelated for allowing the steam storage tank to perform its intended function.

The first subcomponent of the steam storage tank is the housing 52. The housing is formed of metal, plastic, or other similar rigid material. The housing has a concave bottom wall 54 with a threaded bore centrally disposed therethrough. The bottom wall has a plurality of feet 56 extended downwards therefrom for supporting the steam storage tank upon a recipient surface. The housing also includes a tubular side wall 58 integrally coupled to and extended upwards from the bottom wall to define a hollow interior and a top opening for allowing access to the interior. The housing includes a concave top wall 60 removably secured to the side wall over the opening of the housing with bolts 62. The top wall also has a threaded bore centrally disposed therethrough.

The second subcomponent of the steam storage tank is the steam chamber 64. The steam chamber is rigid in structure. It is disposed within the interior of the housing. The steam chamber includes a bottom portion with an inlet valve 66 extended through the side wall of the housing. The inlet valve is adapted to be coupled to and placed in communication with a pressure boiler 68. This coupling is performed with a boiler output pipe 70 coupled to a steam main 72 of the pressure boiler. The top portion of the steam chamber includes an outlet valve 74 extended through the side wall of the housing at a location above the inlet valve. This positioning assures that condensed water entering the inlet valve of the steam chamber is not subsequently transferred to the outlet valve. The steam chamber also includes a hollow fluted intermediate portion 76 between the inlet valve and outlet valve. This fluted portion is used for trapping condensed water present in the steam.

The third subcomponent of the steam storage tank is the drain tap 78. The drain tap is coupled to the bottom portion of the steam chamber and extended through the side wall of the housing. The drain tap is actuated by a handle. By turning the handle in one direction, the tap is opened for draining condensed water accumulated within the bottom portion of steam chamber through interaction with the fluted intermediate portion. By turning the handle in the other direction, the drain tap is closed for preventing such draining of condensed water.

The fourth subcomponent of the steam storage tank is the pressure release valve 82. The pressure release valve is coupled to the top portion of the steam chamber and threadedly extended through the top wall. The pressure release valve is utilized for tapping excess steam pressure from the steam chamber 64 when it is over pressurized, thus preventing the housing from bursting.

The fifth subcomponent of the steam storage tank is the liquid oil 84. The liquid oil is disposed within the interior of the housing. The liquid oil is used for insulating the steam chamber, thus preventing steam disposed therein from condensing into water. Other insulative liquid materials may also be utilized.

The sixth subcomponent of the steam storage tank is the oil drain plug 86. The oil drain plug is threadedly coupled within the bore of the bottom wall 54. The oil drain plug is removable for allowing the oil within the housing to be drained.

The seventh subcomponent of the steam storage tank is the air vent 88. The air vent is threadedly coupled within the bore of the top wall 60. The air vent is used for releasing air from the interior of the housing when the housing is being filled with oil.

The third major component is the shut-off valve 90. The shut-off valve has an input end coupled to and in communication with the outlet valve of the steam storage tank. This coupling is performed with a radiator input pipe 92. The shut-off valve has an output end coupled to and in communication with the inlet valve 32 of the heating coil. The shut-off valve has an opened orientation for allowing delivery of steam within the steam storage tank to the heating coil, thus allowing the coil to dissipate heat and heat the water within the reservoir to produce steam. The shut-off valve has a closed orientation for preventing such delivery of steam to the heating coil.

The fourth major component is the steam trap and thermostatic valve 94. The steam trap and thermostatic valve has an input end and an output end. The input end of the steam trap and thermostatic valve is coupled to the outlet valve 34 of the coil. The steam trap and thermostatic valve is used for trapping water condensing from the steam within the coil. The steam trap and thermostatic valve also regulates the temperature at which the condensed water is allowed to exit through its output end, thereby assisting in the regulation of the temperature within the coil. The regulation temperature of the steam trap and thermostatic valve may be set by a user as desired.

The fifth major component is the circulating boost pump 96. The circulating boost pump has an input end coupled to and in communication with the output end of the steam trap and thermostatic valve. This coupling is performed with a radiator output pipe 98. The circulating boost pump 96 has an output end adapted to be coupled to and placed in communication with a pressure boiler for transferring condensed water thereto for reheating. This coupling is performed with a boiler input pipe 100. The circulating boost pump is operable when electrically energized. Electric energy is supplied to the circulating boost pump from a conventional external electric power source. The circulating boost pump is activated or deactivated through an integral pump switch.

The present invention incorporates a principle of utilizing waste steam from any pressure boiler and converting it to a controlled form of energy that can be used to heat water to a regulatory degree. The present invention is solely functional by steam generated by a pressure boiler when the pressure boiler attains a working pressure of about 10 psi. Steam travels through a pipe connected to a pressure boiler and a steam storage tank. Another similar pipe is then connected to the heating coil. The steam storage tank is capable of storing pressured steam which can be expended at a time frame of about 60 to 90 minutes before exhausting its contents. The heating coil is positioned inside the reservoir. At the outlet valve of the heating coil, a steam trap and thermostatic valve is connected which allows the condensed water in the heating coil to be released at a selected temperature. The reservoir of the radiator is filled with water such that the water covers the entire heating coil. The shut-off valve on the pipe is then opened. With constant heat in the heating coil, the water inside the reservoir absorbs the heat to produce steam for use with a restaurant steam table. If the water temperature in the steam table is heated to its desired degree, the steam would be shut off from the coil by means of the thermostatic shut-off valve. The pipes of the present invention are made from ½ inch or ¾ inch copper, aluminum or stainless steel tubing manufactured to fit specific regulation sized boilers and steam tables used in hotels and restaurants.

The use of the steam storage tank allows excess steam waste from a pressure boiler to be put to use. The steam storage tank allows the boiler to produce only as much steam as is required to operate the present invention. The water level and the temperature in the existing water storage tank decrease slightly as the demand for hot water and steam becomes greatest around peak operational times in a hotel environment, mainly during breakfast hours, lunch hours, and dinner hours. With this demand at such times the boiler will be functional and the steam pressure will continue to build up to meet demand, thereby creating the steam pressure needed for effective functioning of the present invention.

The present invention is a most energy efficient system which saves dollars on costly gas and electric bills for any establishment that has a steam table and a pressure boiler, such as hotels and large restaurants. It is also 100% environmentally safe. The present invention can also be applied to homes that have boilers and separate water heating units. The system can be installed without displacing any original heating components from a steam table or a water heating unit. In the event the pressure boiler has to be shut down for maintenance work, owners can temporarily switch back to electricity or gas for heating the steam tables. The present invention may also incorporate a mechanical or electrical sensing device for activating and de-activating the boiler to regulate the outward flow of steam.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A steam-heated radiator system for utilizing waste steam from a pressure boiler for heating water in a restaurant steam table comprising, in combination:

a radiator further comprising:

a rigid box-shaped reservoir for holding water therein and adapted to be positioned within a restaurant steam table with the reservoir having a bottom wall, a pair of opposed long walls, a pair of opposed short walls with the walls connected to the periphery of the bottom wall and extended upwards therefrom to define a hollow interior and a top opening for allowing access to the interior, and a plurality of feet coupled to and extended downwards from the bottom wall for supporting the reservoir in a generally level orientation;

a rigid elongated tubular heating coil disposed in the reservoir for heating water placed in the reservoir to form steam, the heating coil formed of a thermally conductive material, the heating coil having an inlet valve at one end extended through a short wall of the reservoir, an output valve at the other end extended through the other short wall of the reservoir, and a serpentine intermediate portion therebetween disposed within the interior of the reservoir; and a plurality of clamps coupled between the heating coil and reservoir for holding the heating coil in a stationary horizontal position;

a steam storage tank for storing steam from a pressure boiler for use at a later time, the steam storage tank further comprising:

a rigid housing having a concave bottom wall with a plurality of feet extended downwards therefrom, a tubular side wall coupled to and extended upwards from the bottom wall to define a hollow interior and a top opening for allowing access to the interior, and a concave top wall removably secured to the side wall and over the opening of the housing;

a steam chamber disposed within the interior, the steam chamber including a bottom portion with an inlet valve extended through the side wall of the housing and with the inlet valve adapted to be coupled to and placed in communication with a pressure boiler, a top portion including an outlet valve extended through the side wall at a location above the inlet valve, and an hollow fluted intermediate portion therebetween;

a closable drain tap coupled to the bottom portion of the steam chamber and extended through the side wall for draining condensed water accumulated within the steam chamber;

a pressure relief valve coupled to the top portion of the steam chamber and extended through the top wall for tapping excess steam pressure from the steam chamber;

liquid oil disposed within the interior of the housing for insulating the steam chamber;

a removable oil drain plug coupled to the bottom wall for allowing the oil to be drained from the interior; and an air vent coupled to the top wall of the housing for releasing air from the interior when the housing is being filled with oil;

a shut-off valve having an input end coupled to and in communication with the outlet valve of the steam storage tank and an output end coupled to and in communication with the inlet valve of the heating coil and with the shut-off valve having an opened orientation for allowing delivery of steam within the steam storage tank to the heating coil for dissipating heat and a closed orientation for preventing such delivery;

a steam trap and thermostatic valve having an input end and an output end with the input end coupled to the outlet valve of the coil for trapping water condensing from steam and regulating the temperature at which the condensed water is allowed to exit through the output end; and a circulating boost pump having an input end coupled to and in communication with the output end of the steam trap and thermostatic valve and an output end adapted to be coupled to and placed in communication with a pressure boiler for transferring condensed water thereto for reheating.

2. The steam-heated radiator system as set forth in claim 1 wherein the radiator further includes a thermostatic valve disposed within the reservoir and coupled between the intermediate portion and inlet valve of the coil, the thermostatic valve settable and maintainable at a selected temperature for allowing steam to be generated from water placed in the reservoir, the thermostatic valve having an opened orientation for allowing steam to enter the coil for heating water to a selected temperature, the thermostatic valve further having a closed orientation for preventing steam from entering the coil when the selected temperature is attained.

3. A steam heating radiator system comprising:

a radiator including an open reservoir for holding water therein adapted to be positioned within a restaurant steam table and a generally tubular heating coil positioned within the reservoir;

a steam storage tank coupled to the heating coil for delivering steam thereto and couplable to a pressure boiler for receiving steam therefrom for subsequent use in the heating coil;

steam trap means coupled to the heating coil for trapping water condensing from the steam;

pump means coupled to the steam trap means for receiving the water condensed from the steam and couplable to a pressure boiler for transferring the water thereto for reheating;

water temperature regulation means coupled between the steam trap means and pump means for controlling the temperature of the condensed water delivered to the pump means; and coupling means for coupling the coil to the reservoir.

4. The steam-heated radiator as set forth in claim 3 wherein the steam storage tank comprises:

a housing having a hollow interior and a sealable opening for allowing access to the interior;

a steam chamber for holding steam therein disposed within the interior and having an inlet and an outlet extended therefrom and through the housing;

a drain tap coupled to the steam chamber and extended from the housing for draining condensed water accumulated within the steam chamber;

a pressure relief valve coupled to the steam chamber and extended through housing for tapping excess steam pressure from the steam chamber;

a liquid insulating material disposed within the interior of the housing for insulating the steam chamber;

a removable drain plug coupled to the housing for allowing the insulating material to be drained from the interior; and an air vent coupled to the housing for allowing air to be vented therefrom.

* * * * *